US006152321A

United States Patent [19]

Staar

[11] Patent Number: 6,152,321

[45] Date of Patent: Nov. 28, 2000

[54] IDENTIFICATION SYSTEM FOR ARTICLES IN VENDING APPARATUS OF HOTEL ROOMS

[75] Inventor: Marcel Jules Staar, Brussels, Belgium

[73] Assignee: Staar North-South Co., Belgium

[21] Appl. No.: 09/174,292

[22] Filed: Oct. 16, 1998

[30] Foreign Application Priority Data

Oct. 17, 1997 [BE] Belgium ..... 09700828

[51] Int. Cl.[7] ..... B65H 7/00

[52] U.S. Cl. ..... 221/17; 221/6

[58] Field of Search ..... 221/4, 6, 7, 8, 221/155, 17; 340/542, 556, 568, 585

[56] References Cited

U.S. PATENT DOCUMENTS 4,791,411 12/1988 Staar .

*Primary Examiner*—Christopher P. Ellis
*Assistant Examiner*—Gene O. Crawford
*Attorney, Agent, or Firm*—Robert W. Becker & Associates

[57] ABSTRACT

An identification system for articles in manual free automatic vending apparatus for hotel rooms is provided. Electric or electronic sensors detect the presence or absence of a stored article in an individual location. Means are provided to detect the presence or absence of a ferromagnetic metal wire that holds a cork in place on a valuable article, especially a champagne bottle.

7 Claims, 2 Drawing Sheets

IDENTIFICATION SYSTEM FOR ARTICLES IN VENDING APPARATUS OF HOTEL ROOMS

BACKGROUND OF THE INVENTION

The present invention relates to an identification system for articles in manual free access automatic vending apparatus for hotel rooms, wherein sensors detect the presence or absence of a stored article in a given location.

U.S. Pat. No. 4,791,411 describes an automatic vending system for articles for refrigerators of hotel rooms.

In such apparatus, the articles that are to be offered for sale are placed in reserved locations, each of which is surveyed or scanned by individual electric or electronic detectors in order to be able to determine at any given moment if an article is present or absent from its location, thus indicating the need to replace the sold articles and to bill for the same.

The advantage of this system is that a customer may remove an article and, after examination, may change his mind and replace the article in the vending apparatus without being improperly billed therefor, as is the case with other automatic vending apparatus on the market that are provided with means such that a customer can not replace an article once removed from the apparatus, thus forcing the customer to consume an article that he may no longer desire after examination thereof.

In such free access automatic apparatus, the articles are merely placed or deposited in locations adapted on a form, a position or to a determined graphic identification so that each article may be deposited or eventually freely replaced in a reserved location.

In such apparatus, the articles are disposed on interchangeable trays that group series of articles, intentionally of the perceptibly same vending price.

Thus, if a customer mistakenly replaces an article in another location of the same type, this will not require a difference in the billing.

However, this will not be the case for a tray that is reserved for large bottles, grouping, for example, locations for three bottles of mineral water and one location for a champagne bottle, each of which is perceptibly of the same volume and the same size.

However, the selling price of a bottle of water and a bottle of champagne are entirely different, and an unscrupulous customer could be tempted to intentionally remove a champagne bottle from its location and replace it by a bottle of water with the hope he will be wrongly billed in his favor.

In particular, the customer would be billed for a bottle of water instead of a champagne bottle because a reserved location for a water bottle will be empty and the location reserved for the champagne bottle will be occupied, in this case by a bottle of water that is perceptibly of the same size.

In addition, it is possible that a customer could unintentionally, by simple mistake, interchange a bottle of water for a bottle of champagne.

Thus, it is important to prevent a bottle of champagne from being billed even though it is still present in the vending apparatus, although in a water bottle location.

It is therefore an object of the present invention to provide an identification system for articles in automatic vending apparatus wherein such a system reduces the possibility for incorrect billing.

SUMMARY OF THE INVENTION

This object is realized by the inventive identification system, which comprises means to detect the presence or absence of a ferromagnetic metal wire that holds a cork in place on a valuable article, especially a champagne bottle.

The inventive system provides a very reliable means for identification, and is very economical to realize.

Pursuant to the present invention, means are proposed for automatically detecting the metal wire that holds the cork of a champagne bottle in place, with such wire being made of ferromagnetic material and thus being able to influence a magnetic detection system that is invisibly placed in the proximity of the neck of the champagne bottle when the bottle is stored in one of the locations reserved for large bottles in the vending apparatus.

Advantageously, means are provided that allow for detection of the presence of a champagne bottle in any location reserved for large bottles of perceptibly the same size, thus making it possible to differentiate such a champagne bottle from a water bottle.

Further specific features of the present invention will be described in detail subsequently.

BRIEF DESCRIPTION OF THE DRAWINGS

In particular, the present invention will be described more clearly from the following specification in conjunction with the accompanying schematic drawings, in which.

DESCRIPTION OF PREFERRED EMBODIMENTS

Figure 1:
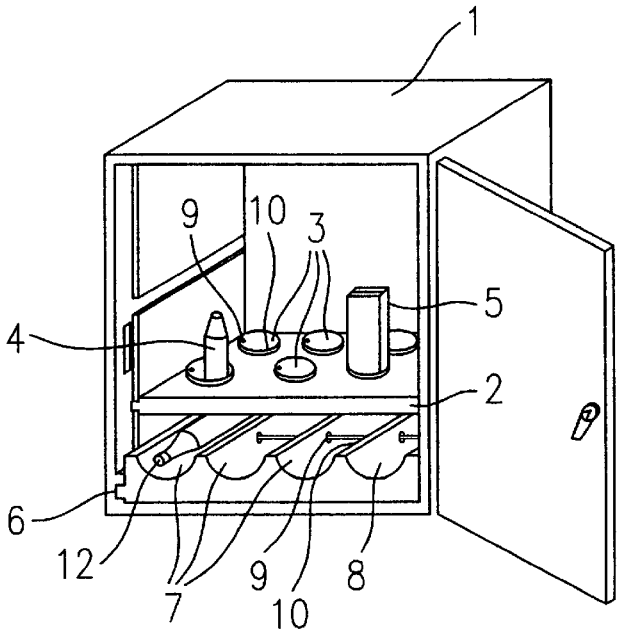
FIG. 1 shows a refrigerator equipped with one exemplary embodiment of the inventive identification system.

Referring now to the drawings in detail, FIG. 1 shows a refrigerator 1 for hotel rooms. In the illustrated embodiment, the refrigerator comprises a tray 2 having six locations 3 for vertically receiving drinks in bottles or cans 4 and 5.

A further tray 6 can horizontally receive, for example, four large bottles. In particular, the locations 7 can be provided for water bottles and the lo cation 8 for a champagne bottle.

The locations 3, 7 and 8 are each equipped with infrared transmitters/receivers 9 and 10 in order to be able to detect the physical presence or absence of an article in its individual location.

Figure 2:
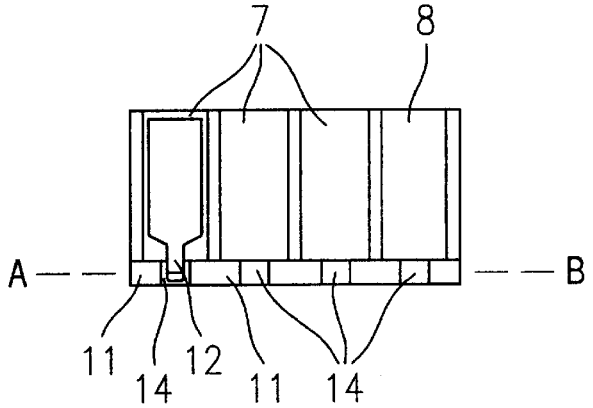
FIG. 2 is a plan view of the lower tray of the refrigerator of FIG. 1.

FIG. 2 is a plan view of the perspective view of the tray 6 of FIG. 1.

Figure 3:
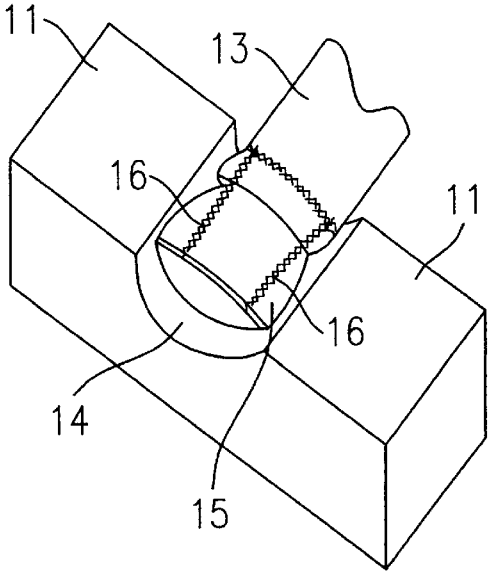
FIG. 3 is an enlarged view showing the neck of a champagne bottle in a cavity of the tray of FIG. 2.

With the identification system according to one preferred embodiment of the present invention, the locations 7 and 8 are provided with walls 11 such that the neck 12,13 of a bottle assumes a centered position in a cavity 14 that partially surrounds the neck of the bottle, as shown in the enlarged view of FIG. 3.

In particular, FIG. 3 illustrates the neck 13 of a champagne bottle equipped with a cork 15, which is held on the bottle by a classical ferromagnetic wire 16 that is able to be detected, for example, by a system to be subsequently described.

Figure 4:
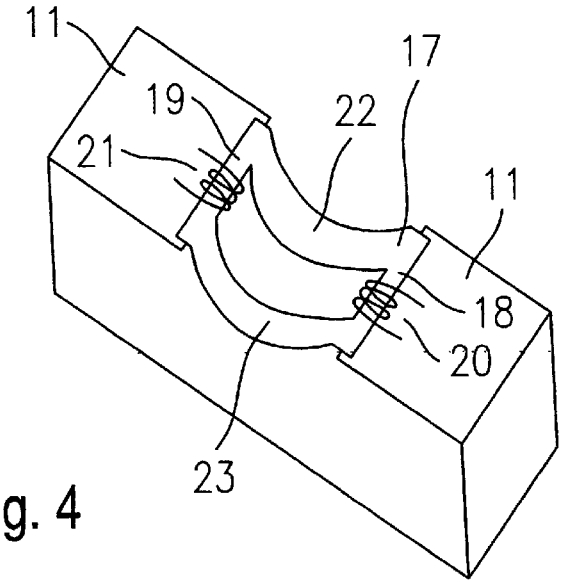
FIG. 4 is an enlarged view of one exemplary embodiment of the inventive identification system for the bottle neck holding cavity of the tray of FIG. 2.

FIG. 4 illustrates a thin piece 17 of ferromagnetic material that is curved so as to follow the configuration of the cavity 14 and is invisibly placed under the plastic molded wall that forms the latter. The piece 17 is thus positioned in the proximity of the neck 12 of a water bottle or the neck 13 of a champagne bottle.

The piece 17 forms the cores 18, 19 of two electric wire coils, one of which acts as a transmitter 20 and the other of which acts as a receiver 21. The piece 17 also forms the parts 22, 23 to realize polar pieces for conducting the magnetic flux from one coil to the other.

If the coil 20 is briefly fed, for example, by an alternating current, the emitted magnetic flux lines, conducted by the polar pieces 22 and 23, will induce in the coil 21 a proportional corresponding current.

If at the moment that the coil 20 is energized a champagne bottle cork with its ferromagnetic wire 16 is located in the cavity 14, very close to the polar pieces 22 and 23, the different and close perpendicular passages of the ferromagnetic wires will short circuit a part of the magnetic flux lines emitted by the coil 20, and this current will be proportionally reduced in the coil 21. Thus, a signal to be read in the receiver coil 21 will be obtained that is more significant with a stored water bottle and less significant in the coil 21 for a stored champagne bottle.

Pursuant to an embodiment of the present invention, a tray 6 with four locations for large bottles (see FIGS. 1 and 2) can be equipped with infrared transmitters/receivers 9 and 10 to detect the physical presence of a bottle in its location. On the other hand, the four raised surrounding walls are equipped with magnetic sensors to determine, with a sequential reading of the infrared and the magnetic sensors, each time for the four locations, the number of water and champagne bottles that are to be billed, regardless of in which locations 7 and 8 the bottles are stored or absent.

Although the present invention has been described in conjunction with a magnetic sensor composed of coils of electric wire, other detectors are also possible. For example, it is possible to have one coil of electric wire as a transmitter and one Hall effect cell. It is also possible to have an electric wire coil that is part of an oscillating electronic circuit. In any case, the principle always remains the same, namely that the presence or absence of the ferromagnetic material wire that maintains or holds a champagne bottle cork in place influences a magnetic field that is emitted in the proximity of the neck of the bottles that are to be differentiated.

It is to be understood that although the present invention has predominantly referred to the detection of champagne bottles, other valuable articles can also be detected, such as expensive sparkling wine.

Figure 5:
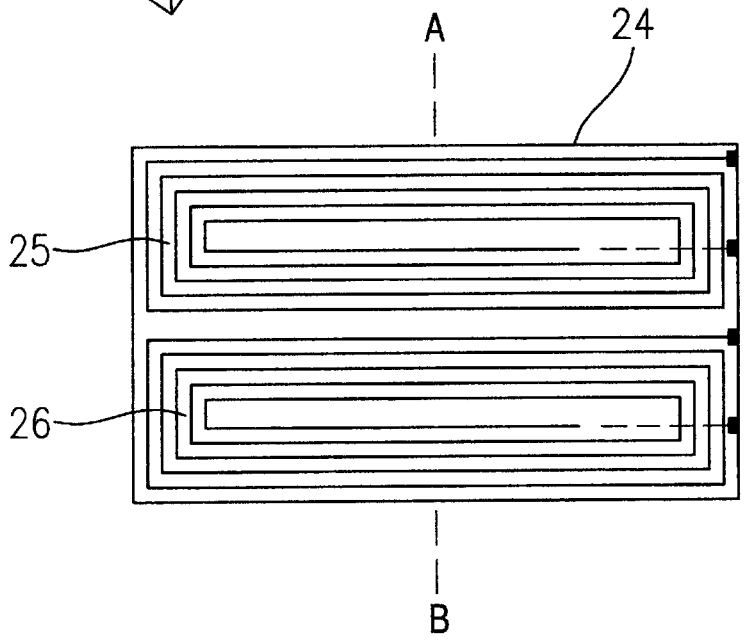
FIG. 5 shows another exemplary embodiment of the identification system of the present invention in the form of a printed circuit.
Figure 6:
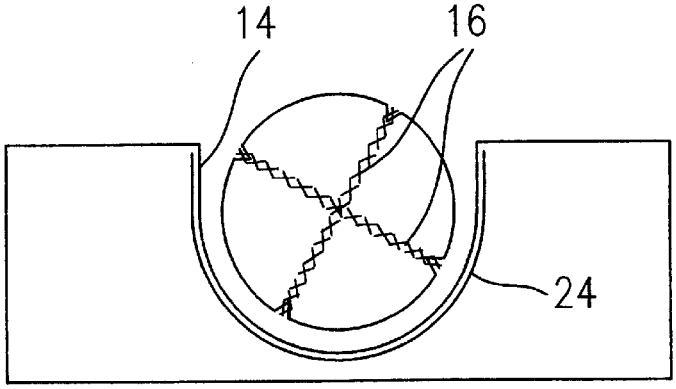
FIG. 6 shows the embodiment of FIG. 5 in place in a bottle neck carrying cavity.

FIGS. 5 and 6 illustrate an exemplary embodiment of a system realized by a printed circuit 24 that is designed to be fixed or glued below the bottle neck location 14.

The one-piece printed circuit 24 is intended to replace the electric wire coils 20, 21 and the ferromagnetic metal armature 18, 19, 22, 23 shown in FIG. 4.

The circuit 24 has one printed transmitter spiral copper coil 25 and one printed receiver spiral copper coil 26. The circuit 24 is flexible and can be fixed or glued below the surrounding walls of a location 14.

The presence or absence of a nearby ferromagnetic wire 16, which holds the cork of a champagne bottle in place, will, or in the case of the absence of the bottle will not, influence the magnetic field lines between the transmitter coil 25 and the receiver coil 26.

The specification incorporates by reference the disclosure of Belgium priority document 09700828 of Oct. 17, 1997.

The present invention is, of course, in no way restricted to the specific disclosure of the specification and drawings, but also encompasses any modifications within the scope of the appended claims.

What is claimed is:

1. An identification system for articles in manual free access automatic vending apparatus for hotel rooms, comprising sensors to detect the presence or absence of a stored article in a given location, and means to detect the presence or absence of a ferromagnetic metal wire that holds a cork in place on a champagne or sparkling wine bottle.

2. An identification system according to claim 1, wherein said means detect the presence or absence of a ferromagnetic metal wire comprises a transmitter and a receiver of a magnetic field disposed in the vicinity of a neck of an article when the latter is stored in a reserved location in said vending apparatus.

3. An identification system according to claim 2, wherein magnetic field lines generated between said transmitter and said receiver extend through a detection location where the presence of said ferromagnetic metal wire of said bottle will, if present, act upon said magnetic field lines.

4. An identification system according to claim 2, wherein said transmitter and said receiver are provided on a flexible printed circuit that is bent in order to partially surround the neck of said article, said printed circuit preferably being disposed along a reserved location in the form of a cavity for receiving said neck of said article.

5. An identification system according to claim 2, wherein said transmitter and said receiver of said magnetic field comprise two electric wire coils that are spaced from one another on at least part of the periphery of a given location in the vicinity of said neck of said article.

6. An identification system according to claim 5, wherein a thin armature piece of ferromagnetic metal is provided and forms a core of said two electric coils and also forms polar pieces that are adapted to conduct magnetic flux from one coil to the other.

7. An identification system according to claim 6, wherein said thin ferromagnetic armature is curved so as to surround part of said bottle in said vicinity of said neck thereof, in order to increase the surface area of said polar pieces on which said ferromagnetic metal wires of said bottle are adapted to act.

* * * * *